US011434853B2

(12) United States Patent
Jung

(10) Patent No.: US 11,434,853 B2
(45) Date of Patent: Sep. 6, 2022

(54) AIR CLEANER FOR VEHICLE

(71) Applicants: HYUNDAI MOTOR COMPANY, Seoul (KR); KIA MOTORS CORPORATION, Seoul (KR)

(72) Inventor: Jae Hyeon Jung, Ansan-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 119 days.

(21) Appl. No.: 16/749,397

(22) Filed: Jan. 22, 2020

(65) Prior Publication Data

US 2021/0131388 A1 May 6, 2021

(30) Foreign Application Priority Data

Nov. 5, 2019 (KR) ..... 10-2019-0139868

(51) Int. Cl.
*F02M 35/024* (2006.01)
*F02M 35/02* (2006.01)

(52) U.S. Cl.
CPC .. *F02M 35/02416* (2013.01); *F02M 35/0202* (2013.01); *F02M 35/0216* (2013.01); *F02M 35/02475* (2013.01)

(58) Field of Classification Search
CPC ..... F02M 35/02416; F02M 35/0202; F02M 35/0216; F02M 35/02475; F02M 35/024; F02M 35/02
USPC ..... 55/482, 490–519
See application file for complete search history.

(56) References Cited

U.S. PATENT DOCUMENTS 4,774,217 A * 9/1988 Takeuchi ..... B01J 37/0018 502/178
2010/0154369 A1* 6/2010 Berisha ..... F02M 35/024 55/493
2014/0223874 A1* 8/2014 Kaufmann ..... F02M 35/0223 55/510
2014/0298612 A1* 10/2014 Williams ..... A47L 7/0004 15/347
2015/0020486 A1* 1/2015 Pettersson ..... B01D 46/0005 55/478
2016/0222926 A1* 8/2016 Aydin ..... F02M 35/0207
2017/0361257 A1* 12/2017 Worrall ..... F02M 35/0201

FOREIGN PATENT DOCUMENTS

KR 20180128146 A 12/2018

* cited by examiner

*Primary Examiner* — Robert A Hopkins
*Assistant Examiner* — Qianping He
(74) *Attorney, Agent, or Firm* — McDonnell Boehnen Hulbert & Berghoff LLP

(57) ABSTRACT

Disclosed herein is an air cleaner for a vehicle. In the air cleaner for a vehicle, air introduced into a body through an inlet port passes through a filter assembly while moving in a horizontal direction, impurities contained in the air are filtered when passing through the filter assembly, and impurities-filtered clear air is discharged through an outlet port while moving in the horizontal direction again.

8 Claims, 4 Drawing Sheets

AIR CLEANER FOR VEHICLE

CROSS REFERENCE TO RELATED APPLICATION

The present application claims priority to Korean Patent Application No. 10-2019-0139868, filed Nov. 5, 2019, the entire contents of which is incorporated herein for all purposes by this reference.

BACKGROUND

1. Technical Field

The present disclosure relates to an air cleaner for a vehicle, and more particularly, to an air cleaner for a vehicle configured to filter impurities by a filter while air introduced through an inlet port moves in a horizontal direction and then discharge the filtered air through an outlet port.

2. Description of the Related Art

An intake system of a vehicle includes an air duct, an air cleaner, and an air hose.

The air duct serves to inhale fresh air from the outside during travelling, the air cleaner serves to not only filter impurities (such as dust and moisture) contained in the inhaled fresh air through a filter (element) but also reduce intake noise and suppress flames when a back fire occurs, thereby preventing a cylinder and a piston from being abraded and preventing oil from being contaminated, and the air hose serves to supply the impurities-removed fresh air to a combustion chamber of an engine.

The air cleaner includes a case consisting largely of a body and a cover, and a filter (element) located in the case to filter impurities.

The air cleaner is overall on a small-sized trend in consideration of the interference with the surrounding components and the installation structure, and accordingly the case constituting the air cleaner is formed to have a low height.

Under the condition where the air cleaner includes a case formed to have a low height, when air moves in an upward or downward direction (hereinafter referred to as the vertical direction) and a filter is equipped to filter foreign matters moving in the vertical direction, there is a problem in that the flow of the air is rapidly changed while the air moves after inhaled until discharged, resulting in an increase in air flow resistance, thereby causing a deterioration in performance of the air cleaner.

The contents described as the related art have been provided only to assist in understanding the background of the present disclosure and should not be considered as corresponding to the related art known to those having ordinary skill in the art.

SUMMARY

An object of the present disclosure is to provide an air cleaner for a vehicle configured to: allow air introduced through an inlet port of a case to move in the case in a leftward or rightward direction (hereinafter referred to as the horizontal direction); have a filter equipped to filter foreign matters moving in the horizontal direction; and discharge the impurities-filtered air through an outlet port of the case, thereby preventing a rapid change in the flow of the moving air, and as a result reducing an air flow resistance and accordingly promoting improved performance.

Another object of the present disclosure is to improve a shape and a structure of the filter, thereby reducing a weight and costs, and promoting a simplified manufacturing process.

According to an embodiment of the present disclosure, an air cleaner for a vehicle includes: a case having an inlet port through which impurities-containing air is introduced and an outlet port through which impurities-filtered air is discharged, and formed to allow the air to move in a horizontal direction from the inlet port to the outlet port; and a filter assembly installed in the case and having a filter filtering the impurities contained in the air. The filter may be installed to be disposed in a vertical direction with respect to the case to filter the impurities contained in the air moving in the horizontal direction.

The case may include: a body having the inlet port and the outlet port and having an inner space in which the filter assembly is installed; and a cover coupled to the body. The filter assembly may be fixed in the case while an upper end and a lower end of the filter assembly are pressed by the cover and the body, respectively.

The inlet port and the outlet port may be provided in the case to protrude in the horizontal direction of the case.

The filter may include a primary filter and a secondary filter. The primary filter may be installed to avoid the inlet port, and the secondary filter may be installed to be located in the outlet port.

The filter may include a primary filter and a secondary filter, and the air cleaner for a vehicle may further include an upper cap and a lower cap integrally coupled to upper and lower portions of the primary filter. The upper cap and the lower cap may each have a central hole penetrating therethrough in the vertical direction, and the primary filter may be coupled to the upper cap and the lower cap while avoiding the central hole.

The upper cap and the lower cap may be urethane foams obtained by foaming a urethane solution while being cured.

The case may include a body in which the filter assembly is installed and a cover coupled to the body. When the body and the cover are coupled to each other, the filter assembly may be fixed in the case while a cover flange formed on the cover presses the upper cap for pressurization and a body flange formed on the body supports the lower cap thereunder.

The air cleaner for a vehicle may further include a frame located at one side of the primary filter and having an upper end and a lower end coupled to the upper cap and the lower cap, respectively.

The primary filter may be formed in a U shape to have an opening at one side thereof. The air cleaner for a vehicle may further include a filter guard located in the opening of the primary filter, coupled to the upper cap and the lower cap, and having a connection port communicatively coupled to the outlet port. The secondary filter may be coupled to the filter guard to cover the connection port.

The connection port may be formed with an air flap across a diameter of the connection port, the air flap minimizing vortex noise of the air while supporting the secondary filter.

DETAILED DESCRIPTION

Hereinafter, an air cleaner for a vehicle according to a preferred embodiment of the present disclosure will be described with reference to the accompanying drawings.

Figure 1:
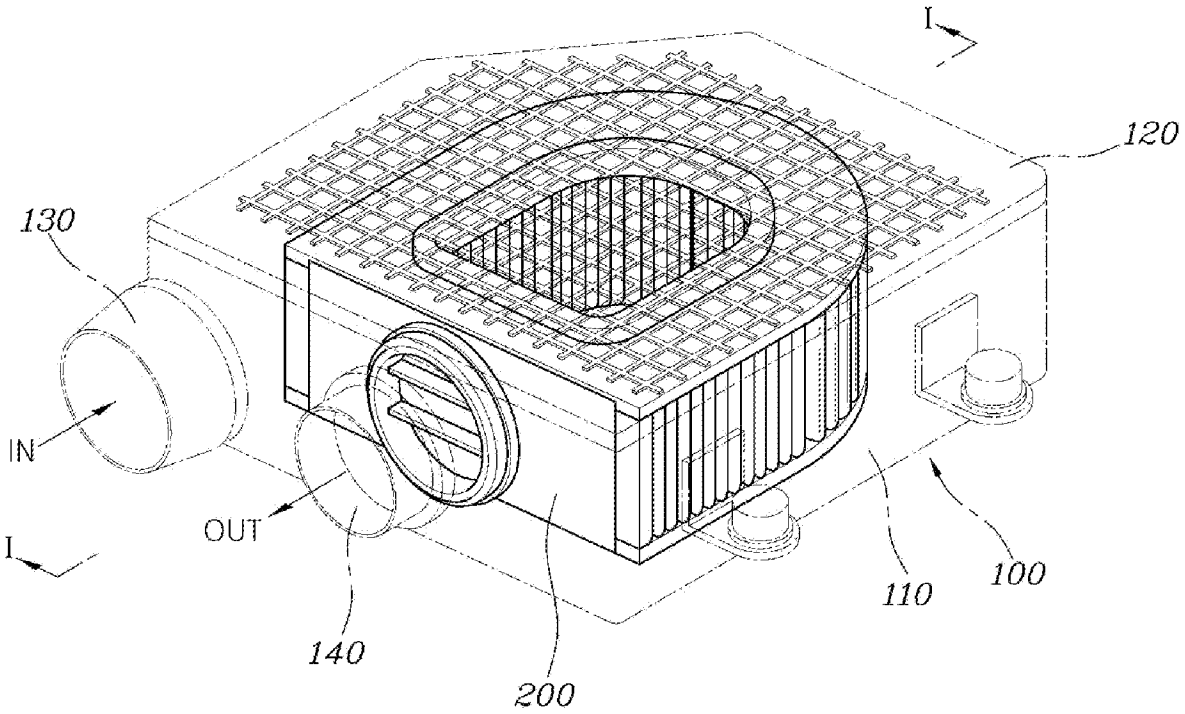
FIG. 1 is a perspective view of an air cleaner for a vehicle according to the present disclosure.
Figure 2:
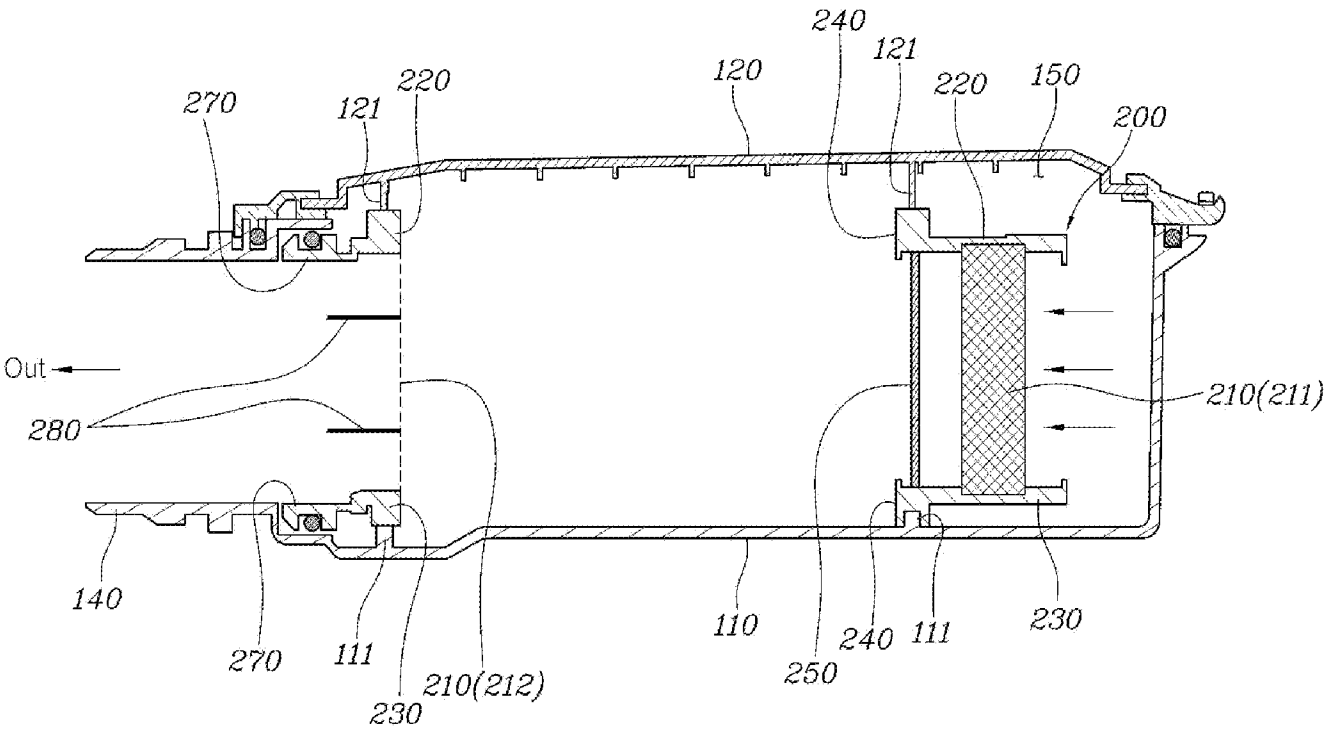
FIG. 2 is a cross-sectional view taken along line I-I of FIG. 1.
Figure 3:
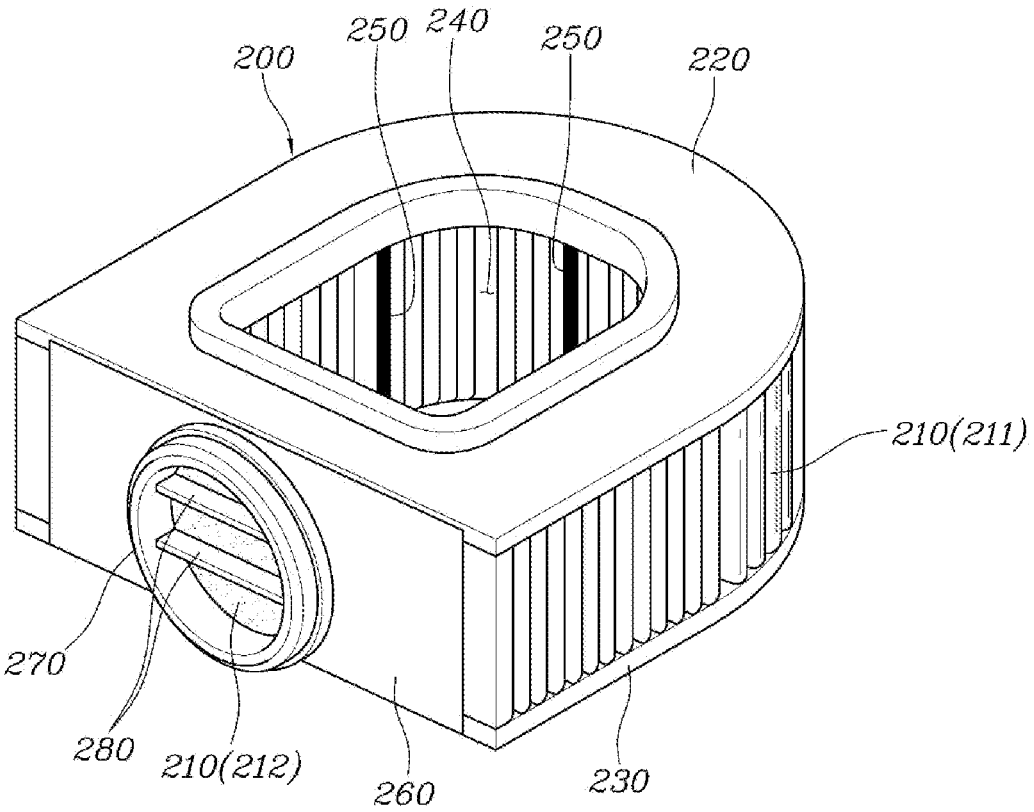
FIG. 3 is a perspective view of a filter assembly according to the present disclosure.
Figure 4:
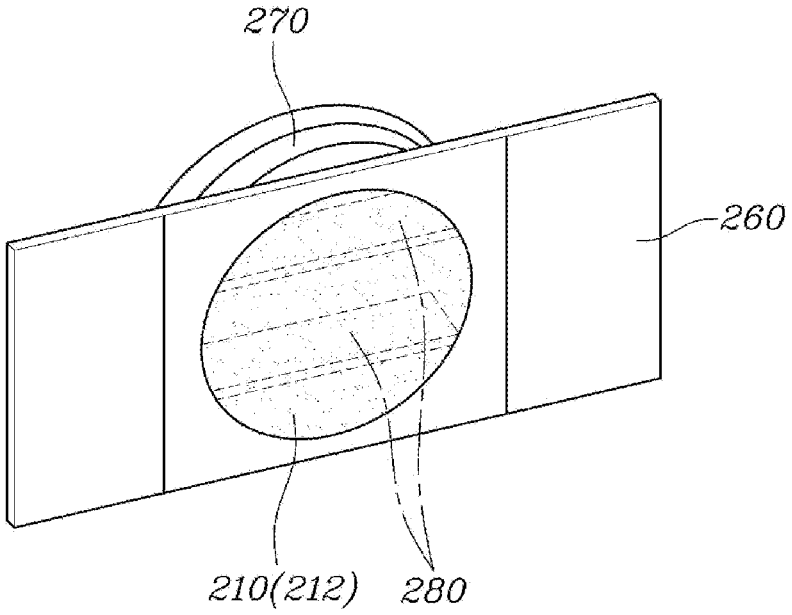
FIG. 4 is a perspective view of a filter guard to which a secondary filter is coupled according to the present disclosure.

As illustrated in FIGS. 1 to 4, the air cleaner for a vehicle according to the present disclosure includes a case 100 and a filter assembly 200 located in the case 100 to filter impurities.

The case 100 includes a body 110 having a predetermined size, and a cover 120 coupled to the body 110 to cover the body 110.

The body 110 has an inlet port 130 through which air (fresh air) containing impurities (dust, moisture, etc.) is introduced and an outlet port 140 through which clean air is discharged after the impurities are filtered while passing through the filter assembly 200. The body 110 also has an inner space 150 connected to the inlet port 130 and the outlet port 140 and allowing the filter assembly 200 to be installed therein.

The air introduced into the body 110 through the inlet port 130 passes through the filter assembly 200 while moving in a horizontal direction along the inner space 150. The impurities contained in the air are filtered when passing through the filter assembly 200, and the impurities-filtered clean air is discharged through the outlet port 140 while moving in the horizontal direction again.

That is, the air cleaner according to the present disclosure is configured to allow air to pass through the filter assembly 200 to filter impurities while moving in the horizontal direction, i.e. leftwards or rightwards, rather than in a vertical direction, i.e. upwards or downwards. To do so, a filter 210, which constitutes the filter assembly 200, is installed to be disposed in the vertical direction with respect to the case 100 to filter the impurities contained in the air moving in the horizontal direction.

Since the air cleaner according to the present disclosure allows air to move in the horizontal direction, it is possible to prevent an occurrence of a rapid change in the flow of the moving air, thereby reducing an air flow resistance and as a result promoting improved performance of the air cleaner.

The inlet port 130 and the outlet port 140 are provided in the body 110 to protrude in the horizontal direction of the case 100, so that the air introduced into the body 110 through the inlet port 130 may be discharged through the outlet port 140 while moving in the horizontal direction.

When the body 110 and the cover 120, which constitute the case 100, are assembled together, the filter assembly 200 located in the case 100 is fixed in the case 100 while an upper end and a lower end thereof are pressed by the cover 120 and the body 110, respectively.

The filter 210, which constitutes the filter assembly 200, consists largely of a primary filter 211 and a secondary filter 212. The primary filter 211 is a filter made of a paper material and installed to avoid the inlet port 130 of the case 100, and the secondary filter 212 is installed to be located in the outlet port 140 of the case 100.

The filter assembly 200 according to the present disclosure further includes an upper cap 220 and a lower cap 230 integrally coupled to upper and lower portions of the primary filter 211, and the upper cap 220 and the lower cap 230 each have a central hole 240 penetrating therethrough in the vertical direction. The primary filter 211 is coupled to the upper cap 220 and the lower cap 230 while avoiding the central hole 240.

The upper cap 220 and the lower cap 230, which are urethane foams, are integrally coupled to the upper and lower portions of the primary filter 211 by pouring and applying a urethane solution on the upper and lower portions of the primary filter 211, and then foaming the urethane solution while being cured.

Conventional upper and lower caps are manufactured of a polypropylene (PP) material by injection molding, heated, and then coupled to a primary filter by thermal welding. In this structure, there is a disadvantage in that the process of manufacturing the upper cap and the lower cap and the process of coupling the upper and lower caps to the primary filter are excessive and complicated.

According to the present disclosure, however, the upper cap 220 and the lower cap 230 are integrally coupled to the upper and lower portions of the primary filter 211 by pouring a urethane solution on the upper and lower portions of the primary filter 211, and then foaming the urethane solution while being cured. This structure makes it possible to simplify the process of manufacturing the upper cap 220 and the lower cap 230 and the process of coupling the upper cap 220 and the lower cap 230 to the primary filter 211, thereby reducing costs and promoting improved productivity, when compared to the conventional structure described above.

The filter assembly 200 according to the present disclosure has a central hole 240 penetrating through the center portions of the upper cap 220 and the lower cap 230 in the vertical direction, thereby reducing a weight and promoting reduced costs.

When the body 110 and the cover 120, which constitute the case 100, are assembled together, the filter assembly 200 located in the case 100 is fixed in the case 100 while an upper end and a lower end thereof are pressed by the cover 120 and the body 110, respectively. In more detail, a cover flange 121 formed on the cover 120 presses the upper cap 220 of the filter assembly 200 for pressurization, and a body flange 111 formed on the body 110 supports the lower cap 230 of the filter assembly 200 thereunder, so that the filter assembly 200 may be fixed in the case 100.

A contact portion between the cover flange 121 and the upper cap 220 and a contact portion between the body flange 111 and the lower cap 230 are kept airtight by a pressing force of the cover flange 121 and a supporting force of the body flange 111, respectively. Therefore, the air introduced into the body 110 through the inlet port 130 does not move directly to the central hole 240 of the filter assembly 200, but necessarily passes through the primary filter 211 and thereafter moves through the central hole 240 to the secondary filter 212 along a horizontal movement path.

In the embodiment according to the present disclosure, a plurality of frames 250 are further included. Each frame 250 is located at one side of the primary filter 211 (located near the central hole), and has an upper end and a lower end coupled to the upper cap 220 and the lower cap 230, respectively.

The frames 250 make it possible to much further strengthen a contact force between the cover flange 121 and the upper cap 220 and a contact force between the body flange 111 and the lower cap 230, thereby much further strengthening an airtightness at the contact portion between the cover flange 121 and the upper cap 220 and an airtightness at the contact portion between the body flange 111 and the lower cap 230.

The primary filter 211 according to the present disclosure is formed in a U shape to have an opening at one side. A filter guard 260 is located in the opening of the U-shaped primary filter 211, and the filter guard 260 is coupled to the upper cap 220 and the lower cap 230 by ultrasonic welding.

The filter guard 260 has a connection port 270, and a passage of the connection port 270 is formed to penetrate through the filter guard 260. The connection port 270 is inserted into the outlet port 140 of the case 100 to be communicatively coupled to the outlet port 140, and the secondary filter 212 is coupled to the filter guard 260 to cover the connection port 270.

When the filter guard 260 is manufactured by injection molding, the secondary filter 212 is inserted into the filter guard 260, thereby producing the filter guard 260 to which the secondary filter 212 is integrally coupled.

In addition, the connection port 270 according to the present disclosure is formed with a plurality of air flaps 280 across a diameter of the connection port 270, the air flaps minimizing vortex noise of the air while supporting the secondary filter 212.

As described above, the air cleaner according to the embodiment of the present disclosure is configured such that: under the condition where the air cleaner includes a case 100 formed to have a low height, the air introduced into the body 110 through the inlet port 130 may pass through the filter assembly 200 while moving in the horizontal direction; impurities contained in the air may be filtered when passing through the filter assembly 200; and impurities-filtered clear air may be discharged through the outlet port 140 while moving in the horizontal direction again. Based thereon, it is possible to prevent a rapid change in the flow of the moving air, thereby reducing an air flow resistance and as a result promoting improved performance of the air cleaner.

Further, according to the present disclosure, the upper cap 220 and the lower cap 230 are formed to be integrally coupled to the primary filter 211 by curing and forming a urethane solution on the upper lower portions of the primary filter 211. Based thereon, it is possible to simplify the process of manufacturing the upper cap 220 and the lower cap 230 and the process of coupling the upper cap 220 and the lower cap 230 to the primary filter 211, thereby reducing costs and promoting improved productivity.

Moreover, according to the present disclosure, the upper cap 220 and the lower cap 230, which constitute the filter assembly 200, each have a central hole 240 penetrating through the center portions thereof in the vertical direction. Based thereon, it is possible to reduce a weight and promote reduced costs.

In addition, according to the present disclosure, the upper cap 220 and the lower cap 230, which constitute the filter assembly 200, are connected to each other through the frames 250. Through the frames 250, it is possible to much further strengthen a contact force between the cover flange 121 and the upper cap 220 and a contact force between the body flange 111 and the lower cap 230, thereby much further strengthening an airtightness at the contact portion between the cover flange 121 and the upper cap 220 and an airtightness at the contact portion between the body flange 111 and the lower cap 230.

Although the present disclosure has been shown and described with respect to specific embodiments, it will be apparent to those having ordinary skill in the art that the present disclosure may be variously modified and altered without departing from the spirit and scope of the present disclosure as defined by the following claims.

The invention claimed is:

1. An air cleaner for a vehicle comprising:

a case having an inlet port through which impurities-containing air is introduced and an outlet port through which impurities-filtered air is discharged, and formed to allow the air to move in a horizontal direction from the inlet port to the outlet port; and a filter assembly installed in the case and having a filter filtering the impurities contained in the air, wherein the filter is installed to be disposed in a vertical direction with respect to the case to filter the impurities contained in the air moving in the horizontal direction, and wherein the filter includes a primary filter and a secondary filter;

the air cleaner further comprises an upper cap and a lower cap integrally coupled to upper and lower portions of the primary filter;

wherein the case includes a body in which the filter assembly is installed and a cover coupled to the body, and when the body and the cover are coupled to each other, the filter assembly is fixed in the case while a cover flange formed on the cover presses the upper cap for pressurization, and a body flange formed on the body supports the lower cap;

wherein the cover flange protrudes from an inner side of the cover toward the filter assembly, and the body flange protrudes from an inner side of the case toward the filter assembly;

wherein the upper cap and the lower cap each have a central hole penetrating therethrough in the vertical direction; and wherein the primary filter is coupled to the upper cap and the lower cap while avoiding the central hole.

2. The air cleaner for a vehicle of claim 1, wherein the case includes:

a body having the inlet port and the outlet port and having an inner space in which the filter assembly is installed; and a cover coupled to the body, wherein the filter assembly is fixed in the case while an upper end and a lower end of the filter assembly are pressed by the cover and the body, respectively.

3. The air cleaner for a vehicle of claim 1, wherein the inlet port and the outlet port are provided in the case to protrude in the horizontal direction of the case.

4. The air cleaner for a vehicle of claim 1, the primary filter is installed to avoid the inlet port, and the secondary filter is installed to be located in the outlet port.

5. The air cleaner for a vehicle of claim 1, wherein the upper cap and the lower cap are urethane foams obtained by foaming a urethane solution while being cured.

6. The air cleaner for a vehicle of claim 1 further comprising a frame located at one side of the primary filter and having an upper end and a lower end coupled to the upper cap and the lower cap, respectively.

7. The air cleaner for a vehicle of claim 1 wherein the primary filter is formed in a U shape to have an opening at one side thereof, the air cleaner for a vehicle further comprising a filter guard located in the opening of the primary filter, coupled to the upper cap and the lower cap, and having a connection port communicatively coupled to the outlet port, wherein the secondary filter is coupled to the filter guard to cover the connection port.

8. The air cleaner for a vehicle of claim 7, wherein the connection port is formed with an air flap across a diameter of the connection port, the air flap minimizing vortex noise of the air while supporting the secondary filter.

* * * * *